United States Patent [19]

Ohkoshi

[11] Patent Number: 4,656,980

[45] Date of Patent: Apr. 14, 1987

[54] CENTRIFUGAL GOVERNOR FOR INTERNAL COMBUSTION ENGINES

[75] Inventor: Masayoshi Ohkoshi, Higashimatsuyama, Japan

[73] Assignee: Diesel Kiki Co., Ltd., Tokyo, Japan

[21] Appl. No.: 753,721

[22] Filed: Jul. 10, 1985

[30] Foreign Application Priority Data

Jul. 11, 1984 [JP] Japan ..... 59-104751[U]
Jul. 12, 1984 [JP] Japan ..... 59-105816[U]

[51] Int. Cl.[4] ..... F02M 39/00

[52] U.S. Cl. ..... 123/179 L; 123/365; 123/373

[58] Field of Search ..... 123/179 L, 365, 373, 123/364

[56] References Cited

U.S. PATENT DOCUMENTS

| | | | |
|---|---|---|---|
| 3,699,941 | 10/1972 | Hughes | 123/179 L |
| 3,727,598 | 4/1973 | Knapp | 123/179 L |
| 3,795,232 | 3/1974 | Snook | 123/179 L |
| 3,884,205 | 3/1965 | Staudt | 123/179 L |
| 4,117,821 | 10/1978 | Kawai | 123/179 L |
| 4,143,634 | 3/1979 | Ritter | 123/179 L |
| 4,433,650 | 2/1984 | Amano | 123/179 L |

FOREIGN PATENT DOCUMENTS

| | | | |
|---|---|---|---|
| 51-139818 | 11/1976 | Japan | 123/179 L |
| 58-7814 | 2/1983 | Japan | 123/373 |
| 1369792 | 10/1974 | United Kingdom | 123/359 |

*Primary Examiner*—Carl Stuart Miller
*Attorney, Agent, or Firm*—Frishauf, Holtz, Goodman & Woodward

[57] ABSTRACT

A centrifugal governor for an internal combustion engine, which includes a sensor lever adapted to engage a cam surface portion of a torque cam determining a starting fuel increment at the start of the engine to displace the control rack into a fuel increasing position, and a cancelling spring interposed between the torque cam and the tension lever and urging the torque cam with a force dependent upon the angularity of the tension lever in a direction of disengaging the sensor lever from the cam surface portion for interrupting the starting fuel increasing action of the governor. When the engine is in a starting condition, biasing means forcibly displaces the torque cam against the urging force of the cancelling spring to a predetermined position wherein the sensor lever can easily engage the cam surface portion, and holds same in the predetermined position for a predetermined period of time.

12 Claims, 4 Drawing Figures

CENTRIFUGAL GOVERNOR FOR INTERNAL COMBUSTION ENGINES

BACKGROUND OF THE INVENTION

This invention relates to a centrifugal governor for a fuel injection pump for use in an internal combustion engine such as a diesel engine, and more particularly to a centrifugal governor of this kind which has an improved function of increasing the quantity of fuel to be supplied to the engine at the start of same.

A centrifugal governor is known, e.g. from Japanese Patent Publication No. 58-7814, which comprises a control rack for regulating the quantity of fuel to be supplied to the engine, flyweights radially displaceable in response to the rotational speed of the engine, a tension lever pivotable through an angle dependent upon the amount of radial displacement of the flyweights, an idling spring for urging the tension lever against radially outward displacement of the flyweights, a torque cam pivotable about a fulcrum shaft thereof and having a cam surface including a cam surface portion determining a fuel increment to be applied at the start of the engine, a sensor lever having one end engaged by the control rack and another end disposed for engagement with the cam surface portion of the torque cam, the sensor lever being adapted to engage with the cam surface portion of the torque cam when the engine is in a starting condition, to permit displacement of the control rack into a fuel increasing position for starting the engine, a cancelling spring interposed between the torque cam and the tension lever and urging the torque cam with a force dependent upon the angularity of the tension lever to cause pivoting of the torque cam about the fulcrum shaft in a direction of disengaging the sensor lever from the cam surface portion of the torque cam, a control lever arranged to be operated at human will, and a floating lever interlocking with the control lever and having one end engaged by the control rack and another end operatively connected with the tension lever through a guide lever. In the centrifugal governor of this type, when the control lever is operated to a full speed position in order to start the engine, the floating lever is pivotally displaced about its end engaging the guide lever, to cause the control rack to be displaced to a starting fuel increasing position, while simultaneously pivotally displacing the tension lever to cause pivoting of the torque cam for control of the starting fuel quantity. However, due to resistance of the link members, the torque cam is pivoted after the control rack has been displaced, so that the sensor lever engaging the control rack can become engaged with the cam surface portion of the torque cam, to thus enable the control rack to be displaced into the starting fuel increment position.

However, when the accelerator pedal is stepped on to start the engine in cold weather, particularly at an ambient temperature of −20° to −40° C., the control rack does not move quickly toward the fuel increasing position in response to stepping-on of the accelerator pedal due to increased viscosity of lubricating oil etc. in such cold weather, causing slow motion of the sensor lever. As a result, the torque cam can be pivotally displaced to a position where the tip of the sensor lever cannot engage the cam surface portion of the torque cam, before the sensor lever becomes engaged with the torque cam, degrading the startability of the engine. Similarly, when the engine is started from a stopping position with the control rack returned to a fuel cut position by a stop lever or a fuel-cut lever, the sensor lever cannot easily engage the cam surface portion of the torque cam, also degrading the startability of the engine.

SUMMARY OF THE INVENTION

It is the object of the invention to provide a centrifugal governor for use with an internal combustion engine, which can ensure positive engagement of the sensor lever with the cam surface portion of the torque cam at the start of the engine even when the viscosity of oil is high such as in cold weather, to thereby improve the startability of the engine.

The present invention provides a centrifugal governor for use with an internal combustion engine, which is provided with biasing means for forcibly displacing the torque cam against the urging force of the cancelling spring, to a predetermined position wherein the sensor lever can easily engage the cam surface portion of the torque cam, and holding same in the predetermined position for a predetermined period of time, when the engine is in a starting condition.

According to a first embodiment of the invention, the biasing means comprises fulcrum shaft-rotating means for causing rotation of the fulcrum shaft of the torque cam in response to manual operation for starting the engine, and transmitting means for transmitting the rotation of the fulcrum shaft to the torque cam to thereby pivotally displace the torque cam about the fulcrum shaft to the predetermined position.

According to a second embodiment of the invention, the biasing means comprises pulling means connected to a portion of the torque cam other than the fulcrum shaft thereof for pulling the torque cam in response to manual operation for starting the engine, to thereby pivotally displace same about the fulcrum shaft to the predetermined position.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
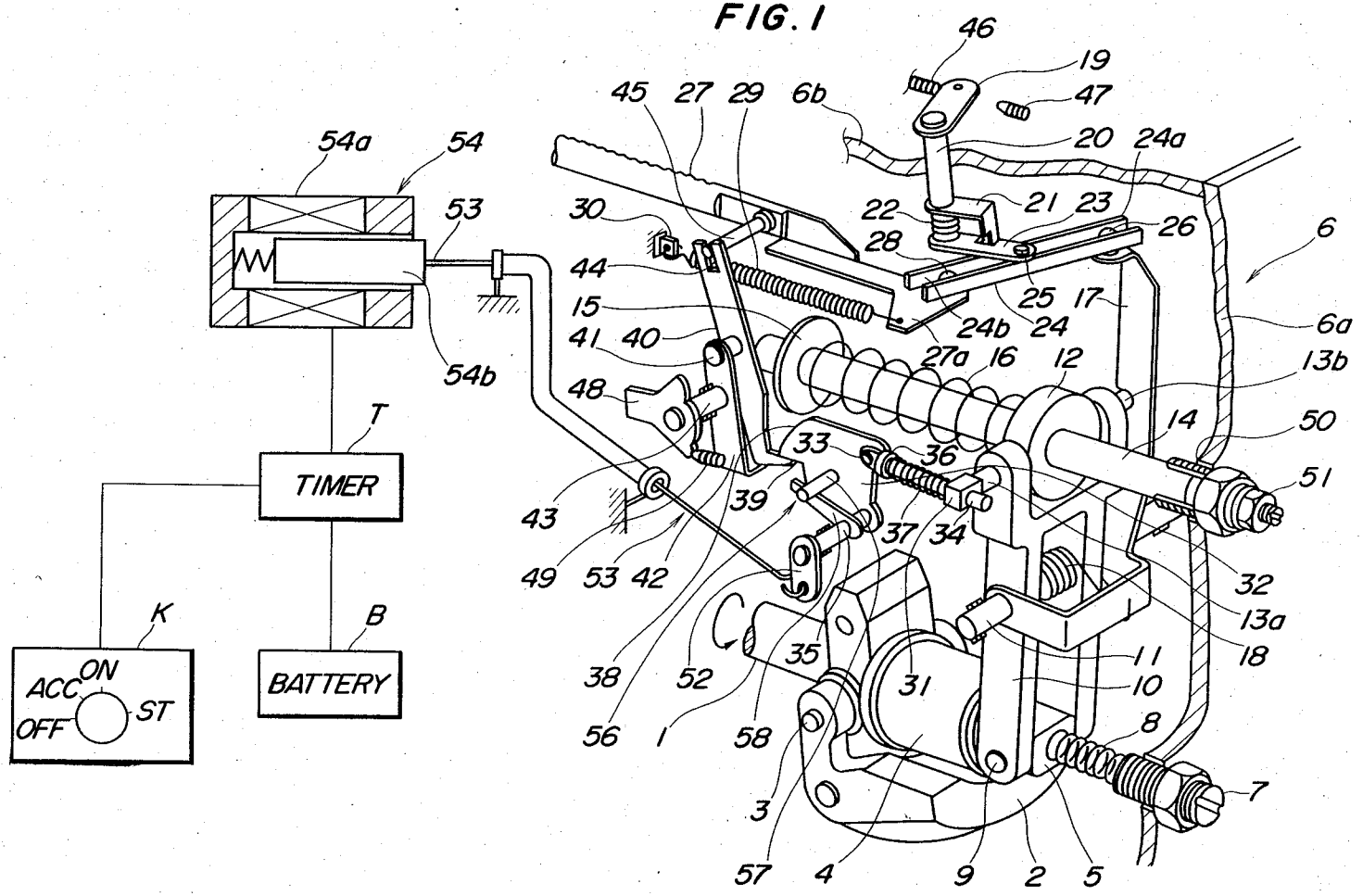
FIG. 1 is a perspective view showing the internal arrangement of a centrifugal governor according to a first embodiment of the invention.

Referring first to FIG. 1, there is illustrated a centrifugal governor for use in a fuel injection pump, according to the first embodiment of the invention. In the figure, reference numeral 1 denotes a camshaft of the fuel injection pump disposed to rotate in unison with an internal combustion engine, not shown, and coupled to flyweights 2, only one of which is shown. The flyweights 2 move radially outward with an increase in the rotational speed of the engine. A sleeve 4 engages the flyweights 2 so that it is displaced rightward as viewed in FIG. 1, along the axis of the camshaft 1 as the flyweights 2 move radially outward. A shifter 5 is attached to the sleeve 4 via a thrust bearing, not shown. An idling spring 8 is interposed between the shifter 5 and a bolt 7 threadedly fitted through a side wall 6*a* forming part of a governor housing 6, to urge the shifter 5 leftward as viewed in FIG. 1. Connected to the shifter 5 is a bifurcated lower end portion of a tension lever 10 which is pivotably supported at its intermediate portion by a pin 11 supported by another side wall forming part of the governor housing 6. Therefore, the tension lever 10 can pivot about the pin 11 as the flyweights 2 move radially outward, through displacement of the sleeve 4 and the shifter 5, while it is urged by the idling spring 8 via the shifter 5 in a direction against the radially outward displacement of the flyweights 2. A movable spring seat 12 is carried by the tension lever 10 at its bifurcated upper end by means of pins 13*a* and 13*b*. A governor shaft 14 axially slidably extends through a central hole of the spring seat 12 and has a fixed spring seat 15 secured on its one end. A governor spring 16, formed of a coiled spring, is arranged around the governor shaft 14 and between the fixed spring seat 15 and the movable spring seat 12, to urge the tension lever 10 in the clockwise direction as viewed in the figure.

A guide lever 17 is pivotably supported at its lower end portion by the tension lever pin 11, and is urged in the counterclockwise direction by a spring 18 arranged around the pin 11, so as to move together with the tension lever 10. A control lever 19, which is located outside a ceiling wall 6*b* of the housing 6 to be operated in response to stepping-on of an accelerator pedal, not shown, of the engine, is connected via a shaft 20 rotatably fitted through the ceiling wall 6*b*, to an L-shaped lever 21 to cause same to move in unison with the control lever 19. The L-shaped lever 21 is urged by a return spring 22 to engage with a supporting lever 23 which is pivotable about the pin 20, so that the supporting lever 23 is usually displaced in unison with the control lever 19. Pivoted to the supporting lever 23 via a pin 25 is an intermediate portion of a floating lever 24 which has one half portion formed with an engaging groove 24*a* in engagement with a pin 26 secured to an upper end of the guide lever 17. The floating lever 24 has another engaging groove 24*b* formed in the other half portion, with which engages a pin 28 secured to a base 27*a* of a control rack 27. Therefore, the control rack 27 moves in response to angular displacement of the control lever 19, to cause the fuel injection pump to increase or decrease the quantity of fuel to be supplied to the engine. A starting spring 29 is connected at its one end to the base 27*a* of the control rack 27 to urge the control rack 27 in a leftward or fuel increasing direction, while its other end is supported by a retainer 30 secured on the side wall of the governor housing 6.

Figure 2:
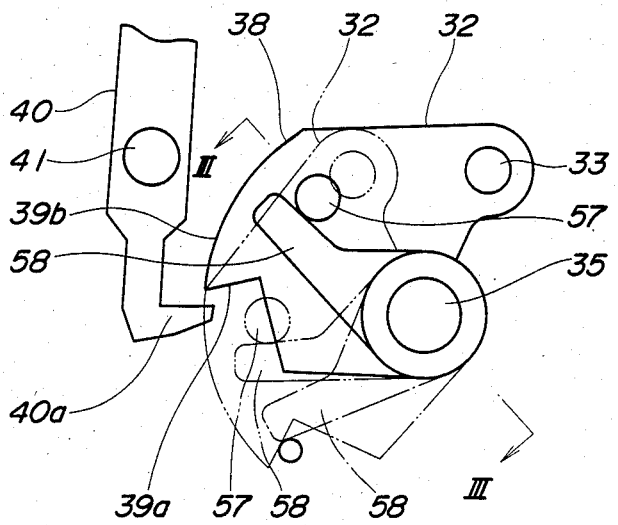
FIG. 2 is an enlarged view showing a torque cam and a sensor lever in FIG. 1, in engagement with each other.

The pin 13*a* of the tension lever 10 has an integral spring seat 31 formed with a central hole through which a rod 34 is axially slidably fitted. The rod 34 has its one end pivoted via a pin 33 to a torque cam 32 which is pivotable about a fulcrum shaft 35 arranged at a location lower than the rod 34. A cancelling spring 37 is arranged around the rod 34 and interposed between a spring seat 36 formed on the one end of the rod 34 and the spring seat 31 formed on the pin 13*a*, to urge the torque cam 32 in the counterclockwise direction. As best shown in FIG. 2, the torque cam 32 has a cam surface 38 at its outer periphery, which includes a cam surface portion or a notch 39*a* for determining a fuel increment to be applied at the start of the engine. The cam surface portion 39*a* is engageable with an engaging tip 40*a* formed at a lower end of a sensor lever 40. The sensor lever 40 is pivotably supported at its longitudinally intermediate portion via a pin 41 by a bracket 42 which is fixed to the side wall of the housing 6 via a pin 43. The sensor lever 40 has a U-shaped groove 44 at its upper end, which is engaged by a pin 45 projecting from a side surface of the control rack 27.

In FIG. 1, reference numerals 46 and 47 denote, respectively, a full speed-setting bolt and an idle-setting bolt which determine opposite extreme positions of the control lever 19. Reference numeral 48 denotes a full load-setting lever which is pivotably supported by the pin 43 of the bracket 42 and abuts against a full load-setting bolt 49 to determine an extreme position of the control rack 27 at full load operation of the engine. The governor shaft 14 has a threaded portion at its right end as viewed in FIG. 1, on which a guide screw 50 and a nut 51 are threadedly fitted to adjust axial position on the governor shaft 14 from the outside of the housing 6 to set the position of the fixed spring seat 15.

Figure 3:
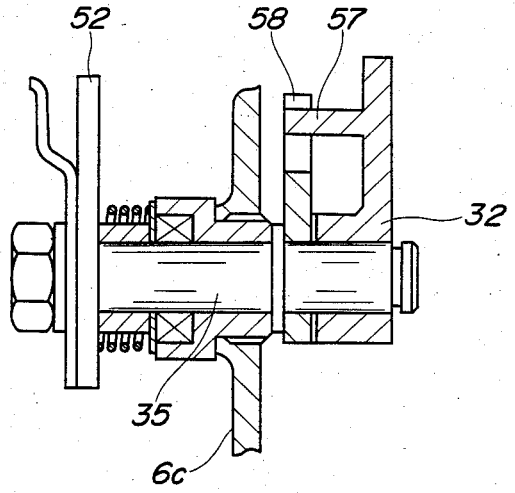
FIG. 3 is a sectional view taken along line III—III in FIG. 2.

The centrifugal governor constructed as above is already known. According to the invention, the torque cam 32 is pivotally displaceable about and relative to the shaft 35 which is rotatably supported by a side wall 6*c* of the governor housing 6, as shown in FIG. 3.

The torque cam shaft 35 extends to the outside through the side wall 6*c* of the housing 6, and a lever 52 is secured at its one end to the outwardly projected end of the shaft 35. The other end of the lever 52 is connected, via a flexible wire 53 as a link member, to an actuator 54 which may comprise a solenoid 54*a* and a movable core 54*b*. As the movable core 54*b* connected to the wire 53 is axially displaced due to energization of the solenoid 54*a*, the lever 52 is pulled to rotate the shaft 35 in the clockwise direction to a predetermined circumferential position. Means 56 for transmitting the rotation of the shaft 35 to the torque cam 32 is interposed between the torque cam 32 and the shaft 35. The means 56 comprises an engaging pin 57 projecting integrally from a side surface of the torque cam 32, and an engaging arm 58 interposed between an inner surface of the side wall 6*c* of the housing 6 and the torque cam 32 and having one end secured on the shaft 35. As shown in FIGS. 2 and 3, the arm 58 radially outwardly extends with its other end arranged below the engaging pin 57. Therefore, as the shaft 35 rotates in the clockwise direction as viewed in FIG. 2, the arm 58 urgingly engages the pin 57, to thereby transmit the rotation of the shaft 35 to the torque cam 32 through the arm 58 and the pin 57 to cause pivotal displacement of the torque cam 32 in the clockwise direction against the force of the cancelling spring 37. The solenoid 54*a* of the actuator 54 is electrically connected via a timer T to a key switch K of the engine and a battery B of same. When the key switch K is manually turned to a position ON while it is being turned from a position ACC to a start position ST, the solenoid 54*a* of the actuator 54 is energized to retract the movable core 54*b*. Incidentally, when the key switch K is turned to the position ACC, the battery B starts to supply electric power to electrical devices installed in the vehicle, while when the key switch K is turned to the position ST, the starter of the engine starts operating.

Upon turning of the key switch K to the position ON, the timer T starts counting and simultaneously starts to supply electric power from the battery B to the actuator 54 to start same, and when a predetermined period of time (e.g. 2–6 seconds) elapses, it interrupts the supply of electric power to render the actuator 54 inoperative, whereby the torque cam shaft 35 is released from the force imparted by the actuator 54, which has so far acted upon the torque cam 32 to displace same to the predetermined circumferential position against the urging force of the cancelling spring 37.

The centrifugal governor according to the invention, constructed as above, operates as follows: When the key switch K is turned to the position ON while it is being turned to the position ST for starting the engine from the position ACC, the timer T starts counting and simultaneously the actuator 54 starts operating to rotate the shaft 35 in the clockwise direction via the link member 53 and the lever 52. Accordingly, the torque cam 32 is forcedly pivoted by the shaft 35 via the transmitting means 56 regardless of the position of the tension lever 10, in the clockwise direction against the urging force of the cancelling spring 37, and is held in the predetermined circumferential position, as indicated by the solid line in FIG. 2. With the torque cam 32 held in this lifted position, the engaging tip 40*a* of the sensor lever 40 can easily engage the cam surface portion (notch) 39*a* of the cam surface 38 of the torque cam 30 to cause the starting fuel increment.

When the accelerator pedal is then stepped on to move the control lever 19 from the idle position to the full speed position to start the engine, the control rack 27 is displaced by the supporting lever 23 in the fuel increasing direction. As a result, the sensor lever 40 is displaced in the counterclockwise direction to bring its engaging tip 40*a* into engagement with the cam surface portion or notch 39*a* of the torque cam 32, thereby allowing the control rack 27 to move into a starting fuel increasing position beyond a full load position which is normally assumed during full load operation of the engine. Then, the key switch K is turned to the position ST to start the engine. Thereafter, when the timer T counts up the predetermined period of time, it interrupts the supply of electric power from the battery B to the solenoid 54*a* of the actuator 54 to thus render the actuator 54 inoperative. Accordingly, the torque cam 32 is set free from the urging force imparted by the arm 58, which has so far acted upon the cam 32 to displace same to the predetermined circumferential position against the urging force of the cancelling spring 37. On this occasion, the sensor lever 40 remains engaged in the starting fuel increasing position (39*a*) as the torque cam 32 is urged in the counterclockwise direction by the cancelling spring 37, until the control lever 19 is returned to the idle position after the start of the engine. When the control lever 19 is returned to the idle position, the supporting lever 23 moves the control rack 27 in the fuel decreasing position via the floating lever 24, so that the engaging tip 40*a* of the sensor lever 40 becomes disengaged from the cam surface portion (notch) 39*a* of the torque cam 32. As the torque cam 32 is then moved to a position as indicated by the two-dot chain line in FIG. 2, the tip 40*a* of the sensor lever 40 is brought into sliding contact with the cam surface 39*b* of the torque cam 32 for fuel quantity control for normal operation of the engine. Thereafter, even when the control lever 19 is operated, the starting fuel increment cannot be obtained but ordinary fuel quantity control is effected by the governor.

Although the foregoing embodiment employs a flexible wire as the link member 53, another type link member may alternatively be used.

Further, a stepping motor, for instance, may alternatively be employed as the actuator 54, to directly force the torque cam shaft 35 into the predetermined circumferential position.

Figure 4:
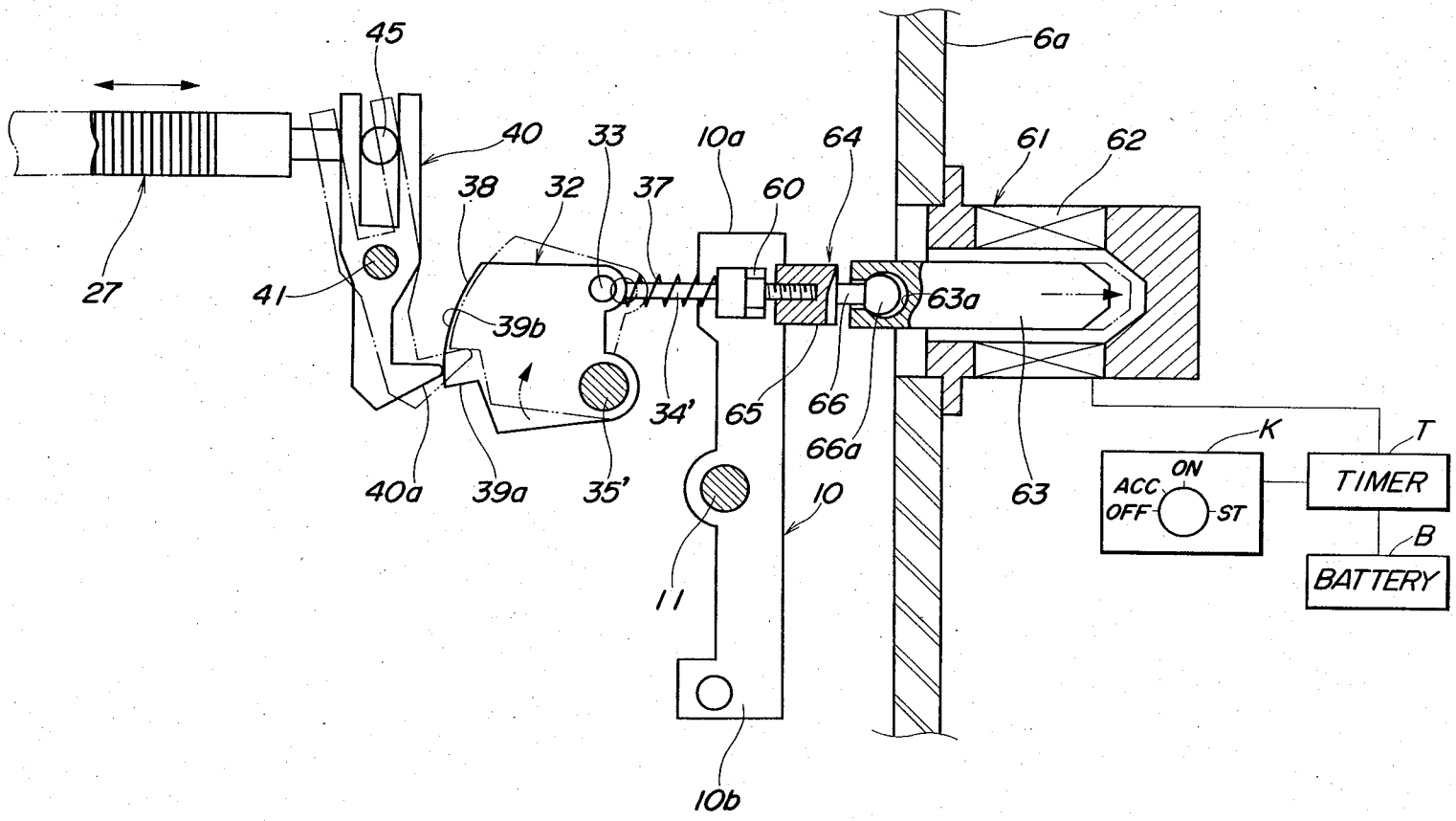
FIG. 4 is a view showing a torque cam, biasing means, and their related parts of a centrifugal governor according to a second embodiment of the invention.

FIG. 4 illustrates essential parts of a centrifugal governor according to the second embodiment of the invention, while its other parts are arranged and constructed in the same manner as those in FIG. 1.

A rod 34′, around which the cancelling spring 37 is loosely arranged, is pivotably connected at its one end to the torque cam 32 via the pin 33 and has a threaded portion at its other end, on which an adjusting nut 60 is threadedly fitted to permit adjustment of the distance between the torque cam 32 and the tension lever 10.

Reference numeral 61 designates an actuator for pivotally displacing the torque cam 32 and holding same in a predetermined circumferential position at the start of the engine. The actuator 61 comprises a solenoid 62 mounted on the side wall 6*a* of the governor housing 6, and a plunger or movable core 63 axially displaceable in response to energization of the solenoid 62 and coupled to the rod 34′ via a ball joint 64. The ball joint 64 comprises a connector 65 threadedly fitted on the other end portion of the rod 34′, and a connecting rod 66 secured to an end face of the connector 65 remote from the rod 34′ and having one end formed with a spherical portion 66*a* which is received within a recess 63*a* formed within one end of the plunger 63. The solenoid 62 is connected to the key switch K and the battery B through the timer T to be energized when the key switch K of the engine is turned to the position ON while it is being turned from the position OFF to the start position ST, to displace the plunger 63 rightward as viewed in FIG. 4, to thereby pull the torque cam 32 up to the starting fuel increment-permitting position. In the same manner as in the first embodiment described before, the timer T operates to hold the plunger 63 in the rightward position and accordingly the torque cam 32 in the pulled-up position for a predetermined period of time (e.g. 2–6 seconds).

The centrifugal governor constructed as above operates as follows: When the key switch K is manually turned to the position ON while it is being turned to the position ST for starting the engine, the solenoid 62 is energized to cause the plunger 63 to be displaced rightward to a position indicated by the two-dot chain line in FIG. 4, whereby the rod 34′ is pulled by the plunger 63 via the ball joint 64 to pull the torque cam 32 upward against the urging force of the cancelling spring 37. The torque cam 32 is then held in the pulled-up position, indicated by the two-dot chain line in FIG. 4, for the predetermined period of time. Then, as the accelerator pedal is stepped on to move the control rack 27 in the fuel increasing direction, the engaging tip 40*a* of the sensor lever 40 is brought into engagement with the cam surface portion (notch) 39*a* of the torque cam 32, as indicated by the two-dot chain lines in the figure. Thus, the starting fuel increment can positively be obtained even when the control rack 27 does not move quickly such as in cold weather. Like the first embodiment, the torque cam 32 is released from the urging force of the plunger 63 after the lapse of the predetermined period of time by the timer T, so that the engaging tip 40*a* of the sensor lever 40 is disengaged from the notch 39*a* and brought into sliding contact with the cam surface portion 39*b* of the torque cam 32, as indicated by the solid lines in FIG. 4, to permit the governor to carry out ordinary fuel quantity control.

Although in the foregoing embodiments, the torque cam 32 is forcedly displaced to the starting fuel increment-permitting position when the key switch K is turned to the position ON, it may alternatively be forced into the same position when the key switch K is turned to the position ACC.

What is claimed is:

1. In a centrifugal governor for use with an internal combustion engine, including a control rack for regulating the quantity of fuel to be supplied to said engine, flyweights radially displaceable in response to the rotational speed of said engine, a tension lever pivotable through an angle dependent upon the amount of radial displacement of said flyweights, a torque cam pivotable about and relative to a fulcrum shaft thereof and having a cam surface including a cam surface portion determining a fuel increment to be applied at the start of said engine, a sensor lever having one end engaged by said control rack, said sensor lever having another end disposed to engage with said cam surface portion of said torque cam when said engine is in a starting condition, to permit displacement of said control rack into a fuel increasing position for the start of said engine, and a cancelling spring interposed between said torque cam and said tension lever and urging said torque cam with a force dependent upon the angularity of said tension lever to cause pivoting of said torque cam about said fulcrum shaft thereof in a direction of disengaging said sensor lever from said cam surface portion of said torque cam, the improvement comprising biasing means for forcibly pivotally displacing, immediately before operation of a starter of said engine, said torque cam in one direction against the urging force of said cancelling spring to a predetermined position wherein said sensor lever can easily engage said cam surface portion of said torque cam, and timer means for causing said biasing means to hold said torque cam in said predetermined position for a predetermined time period, irrespective of a period of time for which said starter is operated, whereby said cancelling spring is operable to force said torque cam into the original position when said predetermined time has elasped.

2. A centrifugal governor as claimed in claim 1, wherein said biasing means comprises rotating means for causing rotation of said fulcrum shaft of said torque cam in response to operation of said starter for starting said engine, and transmitting means for transmitting said rotation of said fulcrum shaft to said torque cam to thereby pivotally displace said torque cam about said fulcrum shaft thereof to said predetermined position.

3. A centrifugal governor as claimed in claim 2, wherein said rotating means includes an actuator, a lever secured at one end thereof to said fulcrum shaft of said torque cam, and a link member coupling another end of said lever with said actuator, said transmitting means including an arm secured at one end thereof to said fulcrum shaft of said torque cam and having a free end, and a pin projecting integrally from one side surface of said torque cam and engageable with said free end of said arm.

4. A centrifugal governor as claimed in claim 3, wherein said link member of said rotating means comprises a flexible wire.

5. A centrifugal governor as claimed in claim 3, wherein said actuator of said rotating means includes a solenoid, and a movable core connected to said link member and displaceable in response to energization and deenergization of said solenoid.

6. A centrifugal governor as claimed in claim 3, said engine having a key switch, and wherein said actuator of said rotating means is operable in response to a turning operation of said key switch of said engine.

7. A centrifugal governor as claimed in claim 1, wherein said biasing means comprises pulling means connected to a portion of said torque cam other than said fulcrum shaft thereof for pulling said torque cam in response to operation of said starter for starting said engine, to thereby pivotally displace same about said fulcrum shaft thereof to said predetermined position.

8. A centrifugal governor as claimed in claim 7, including a spring seat provided on said tension lever, and wherein said pulling means comprises a rod having one end pivotably connected to said portion of said torque cam other than said fulcrum shaft thereof and movably fitted through said spring seat, said cancelling spring being interposed between said torque cam and said spring seat, and an actuator connected to another end of said rod.

9. A centrifugal governor as claimed in claim 8, wherein said actuator of said pulling means comprises a solenoid, and a movable core connected to said another end of said rod and displaceable in response to energization and deenergization of said solenoid.

10. A centrifugal governor as claimed in claim 8, said engine having a key switch, and wherein said actuator of said pulling means is operable in response to a turning operation of said key switch of said engine.

11. A centrifugal governor as claimed in claim 8, including a housing having a side wall, and wherein said actuator of said pulling means is mounted on said side wall of said housing.

12. A centrifugal governor as claimed in claim 8, wherein said rod has a threaded portion at a side more remote from said torque cam with respect to said spring seat, said governor including an adjusting nut threadedly fitted on said threaded portion and rotatable to adjust the distance between said torque cam and said spring seat.

* * * * *